United States Patent [19]

Kinsell, Jr.

[11] 4,245,919

[45] Jan. 20, 1981

[54] BIAS CONTAINER/APPLICATOR TRIM PACKAGE FOR DIMENSIONALLY STABLE SOLID PAINTS AND RELATED MATERIALS

[75] Inventor: William D. Kinsell, Jr., Westlake, Ohio

[73] Assignee: SCM (Canada) Ltd., Don Mills, Canada

[21] Appl. No.: 10,381

[22] Filed: Feb. 8, 1979

[51] Int. Cl.[3] ..... B43K 19/14

[52] U.S. Cl. ..... 401/97

[58] Field of Search ..... 401/96, 97, 91, 88, 401/49, 86, 87; 426/110, 112, 115, 122, 123, 124, 130, 134, 394; 206/602, 606, 627, 526, 527; 229/37–39, 43

[56] References Cited

U.S. PATENT DOCUMENTS

| | | | |
|---|---|---|---|
| 1,436,754 | 11/1922 | Chadwick | 426/110 |
| 2,852,179 | 9/1958 | Bieler | 206/627 |
| 3,539,093 | 11/1970 | Massengill | 206/606 |
| 3,680,764 | 8/1972 | Young et al. | 206/633 |
| 3,846,029 | 11/1974 | Benn et al. | 401/96 |
| 3,967,773 | 7/1976 | Kaufmann | 206/606 |
| 4,073,950 | 2/1978 | Hansen et al. | 426/122 X |

FOREIGN PATENT DOCUMENTS

| | | | |
|---|---|---|---|
| 354600 | 7/1905 | France | 401/97 |
| 357018 | 12/1905 | France | 401/97 |
| 972125 | 1/1951 | France | 401/97 |
| 18819 | of 1914 | United Kingdom | 206/606 |

*Primary Examiner*—Robert W. Michell
*Assistant Examiner*—Jeffrey W. Tayon
*Attorney, Agent, or Firm*—A. J. Gibbons

[57] ABSTRACT

A new concept in painting various substrates is implemented by angle bias container/applicator trim packages having the capability of storing solid paint and other dimensionally stable materials while additionally functioning as a useful applicator. Such applicators are advantageous in that they allow painting without conventional brushes, rollers and similar implements and are readily disposable.

11 Claims, 9 Drawing Figures

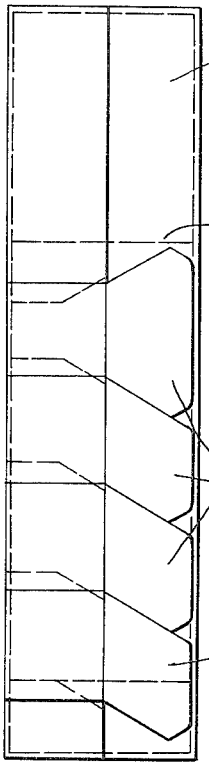
Fig. 1
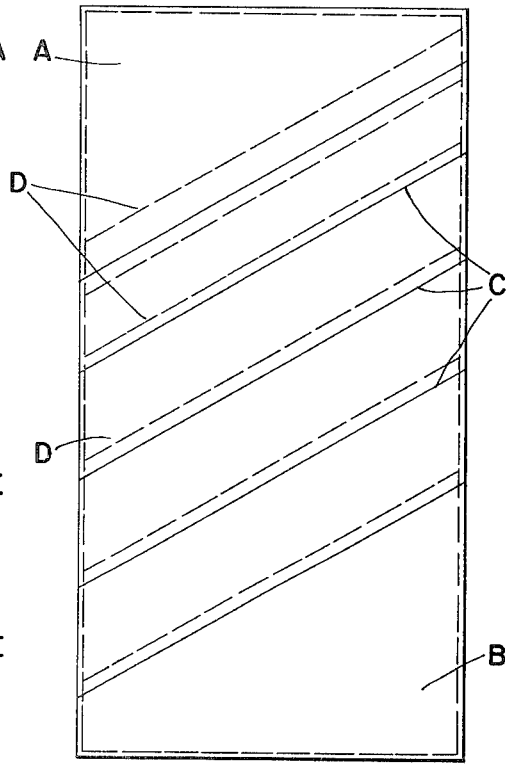
Fig. 2
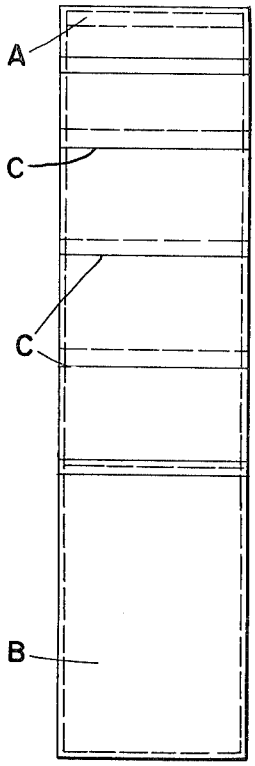
Fig. 3
Fig. 4
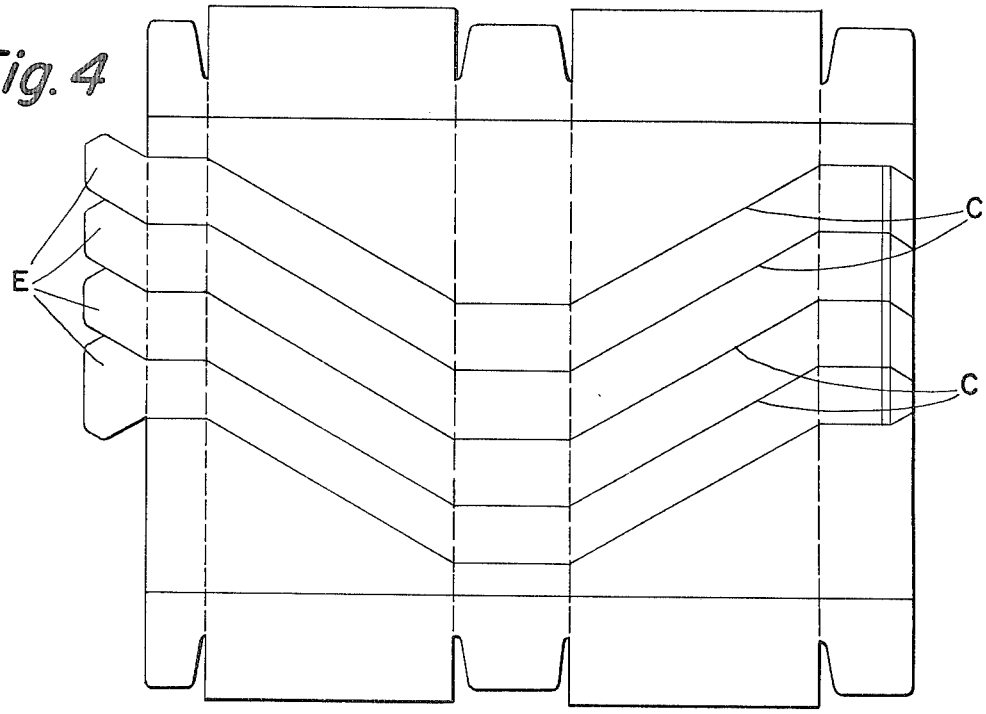

BIAS CONTAINER/APPLICATOR TRIM PACKAGE FOR DIMENSIONALLY STABLE SOLID PAINTS AND RELATED MATERIALS

BACKGROUND OF THE INVENTION

Within the last few years new non-conventional types of paint products having dimensional stability based on ion-bonding and ion particle bonding were developed. These new products called Solid Paints, differ considerably from conventional paints of the prior art in that unique gel properties resulted from cross-linking of certain reactive polymers with "ion clusters" having polar molecule components. Such Solid Paints having non-volatile contents on the order of 40–85 weight percent and gel strengths on the order of 75–175 mm of penetration as measured by a Universal Penetrometer are exemplified in U.S. Pat. Nos. 3,994,849; 3,994,848; and 4,078,116.

Because of the unusual properties of these solid (gel) paints, conventional application tools were not useful. A need thus arose for a suitable container to house the new solid paint product which would allow the convenient application of these coatings to various substrates. This invention relates to a bias container/applicator trim package for dimensionally stable solid paints and related materials having high gel strengths. Since products of this nature have not heretofore been known, the closest art known to Applicant is that shown for rectangular container/applicators in U.S. application No. 010,382 filed concurrently with the instant case.

BRIEF SUMMARY OF THE INVENTION

One object of the present invention is to provide a bias cut container/applicator for solid paint which allows facile painting of various substrates and particularly hard to reach areas as are found in cutting-in-jobs and the painting of corners, edges and trim.

A primary object is to provide a container/applicator bias trim package for storing and applying dimensionally stable solid materials deformable on contact with a surface on which said material may be deposited as a coating or treatment which comprises:

(a) an assembled outer shell formed from an unfolded package as depicted in FIG. 4 and having one or more individually removable tear strips positioned on a bias angle whereby the dimensionally stable and deformable solid material may be exposed for application to a substrate;

(b) an inner lining firmly bonded to the outer shell which functions as a barrier to contain the solid deformable material and to prevent diffusion of air into the package which would undesirably lead to oxidation and the formation of paint skins;

(c) a false bottom which functions to anchor the dimensionally stable solid material to the package and so prevents the dislocation of the material from the package particularly when the package nears exhaustion with consequent soiling of the surroundings; gives support to the entire package for shipment and storage purposes and additionally allows said package to be conveniently grasped in the hand for manual application of the solid material to a substrate;

(d) a top insert which is positioned at the top of the package above the solid material, the bottom of which is formed at a bias angle in the range of 20° to 45° and preferably 30° which in the process of filling with the dimensionally stable solid material, while still in a fluid state, functions as a mold to form the solid material into the biased shape for application to a substrate, said insert being removable on opening of the container.

Further objects include applicators of the above type wherein the dimensionally stable deformable solid material is a solid paint, a solid adhesive, a caulking compound, a sealant and other deformable materials having gel strengths of the order of 75 to 250 mm of penetration on a Universal Penetrometer.

BRIEF DESCRIPTION OF THE DRAWINGS

FIG. 1 is a scaled drawing showing the side view of a typical 30° bias container/applicator depicting the tear tabs.

FIG. 2 is a scaled drawing of the front view of the typical container/applicator package.

FIG. 3 is a drawing illustrating the side view opposite to that shown in FIG. 1.

FIG. 4 is a scaled drawing of the one-piece cut out of the unfolded package.

DETAILED DESCRIPTION OF THE INVENTION

Figure 5:
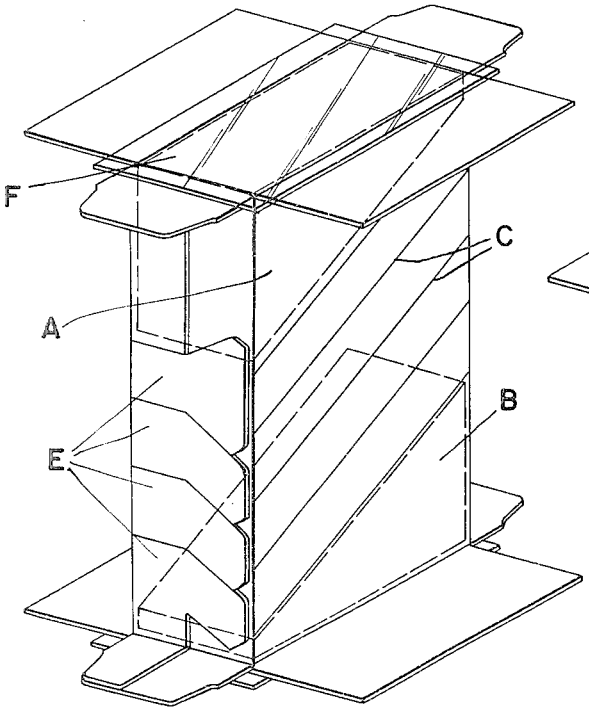
FIG. 5 is a drawing showing details of the partially assembled package and a cross-sectional view of the container showing internal and external die-cuts.

The 30° bias cut container/applicator represents a major improvement over the sister application for a rectangular container/applicator concurrently filed with the instant application. Particular improvements over the rectangular package are summarized as follows:

(1) The package uniquely allows the facile painting of hard to reach areas as are found in cutting-in-jobs and the painting of corners, edges and trim.

(2) The bias of the paint in the package allows the broader application of paint than is the case for a rectangular faced paint package, for a given weight of paint. This is particularly emphasized by comparing a 65 mm bias package with a similar 65 mm rectangular package. The latter gives a paint sweep equivalent to a 65 mm brush. Compared therewith the brush equivalent of the bias package is the length of the bias or $=65 \text{ cosecant } 30°$ $=65 \times 2 \times \sqrt{3}$ $=75$ mm As indicated, this represents an increase of 15 percent in paint swath.

(3) The bias cut package is ergonometrically much superior to the rectangular package. In other words, the rectangular package forces the operator to assume a relatively uncomfortable arm position during application to a substrate which, over a period of time, tires the arm muscles and as a consequence the rectangular block "appears" to become heavier. The positioning of the bias block to the work surface leaves the operator's arm in its most relaxed extended position and in so doing reduces the amount of ineffectual energy lost during the painting process.

The instant invention is specifically exemplified by a detailed consideration of the various drawings.

FIGS. 1, 2 and 3 present a front view and two side views of the assembled bias container/applicator showing the relative positions of the component parts of the trim package. (A) represents the false coated insert situated near the opening at the top of the container. The insert serves to mold the solid paint in the desired 30° bias angle necessary for the invention. Prior to painting, the top tear strip is removed to expose a useable portion of the solid paint and the false insert is removed.

The false bottom insert (B) serves several functions in the overall invention. One function of the false bottom is to anchor the solid paint to the package. Another function of the bottom is to serve as a handle for holding the solid paint during the application of same to the substrate to be painted or treated. A third and extremely advantageous function of the false bottom is to conserve paint so that a substantial amount of the paint in the container becomes available for useful painting. This specific aspect of conservation is more readily understood by referring to the structural components depicted in FIGS. 8 and 9.

In the central portion of the front view the external die-cut perforations (C) are indicated by a solid line. Internal die-cut perforations (D) are shown as dotted lines. It is noted that the internal and external die-cut lines are spaced apart from one another and this feature allows each tear strip to be readily removed as the exposed paint area is depleted to give a clean tear with a minimum of ragged edges.

The side views shown in FIGS. 1 and 3 indicate the relative positions of the false top insert (A), the false bottom (B) and the external and internal tear strip die-cuts (C) and (D) respectively. The tear tab handles (E) allow individual tear strips to be removed for the purpose of exposing a useable quantity of solid paint.

Although the particular container depicted represents a solid paint volume content of approximately 150 cc. the container is readily manufactured in different useable sizes and the invention should not be limited to any one volume or dimension. The shape of the tear handle (tab) can be varied so long as it is readily grasped to easily remove the tear strip. The shape depicted with the tear tab at a 30° downward bias is particularly advantageous in that it positions the operator's hand remote from the exposed paint when peeling away the tear strips. In a similar fashion the number of tear strips will be determined by the height and/or volume of the particular holder applicator.

FIG. 4 illustrates a layout of an unfolded double die-cut 65 mm 30° bias trim package having four tear strips and shows the relative positions of the tear tabs (E) and the external die-cut lines (C) necessary to allow exposure of the consumable material in a 30° bias form. Also illustrated are the relative dimensions of the various tabs and fold lines necessary to enable assembly of the one-piece container. Although various materials may be utilized for the outside surface, 20 pt. cylinder board is particularly advantageous for the purposes of the instant invention. In this figure only the external die-cut lines are indicated. Additional die-cut lines displaced from and parallel to the external die-cut lines, are made on the inside of the cardboard as earlier indicated in FIGS. 1, 2 and 3. The depth of the inside and outside die-cut lines is equal to one-half the thickness of the board. The foldable flaps are cut completely through to within 1.5 mm of the crease line.

The present invention is further illustrated by FIG. 5 which depicts a partially assembled container/applicator. FIG. 5 shows the relative positions of the 30° bias board top insert (A), bias false bottom (B), the external tear strips (C) and the tear tabs (E). It is understood that dimensionally stable, deformable material will occupy the position between the top insert and the false bottom. The top and bottom ends are further sealed with a barrier (F) prior to respective end closure.

The barrier seals include a variety of plastic and metal foil materials either taken alone or in combination. The barrier end seals are advantageously heat sealable thermoplastics or laminates which serve to contain the solid paint and prevent air oxidation. Suitable barriers include laminates consisting of polyester/polyvinylidene chloride/polyethylene and the like. A plastic laminate consisting of nylon/polyvinylidene chloride/polyethylene and 0.0003 to 0.001 inch aluminum foil is especially preferred. The aluminum foil is advantageously sandwiched between layers of the plastic material. The end barriers are sealed to the package by conventional sealing techniques. Although the container may be filled either from the top or bottom after proper sealing of the opposite end, the dimensionally stable solid is advantageously added from the bottom with the container in an inverted position followed by placement of the false bottom, sealing and closure of the bottom tabs.

Figure 6:
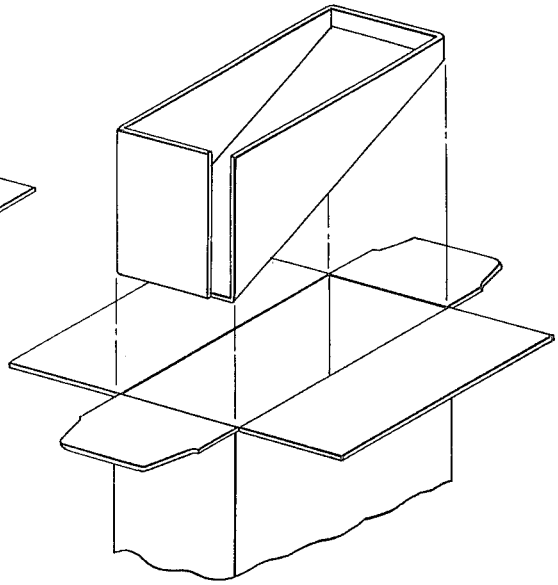
FIG. 6 is a perspective view of the folded false top insert.

FIG. 6 illustrates one type of useful false top insert for the 30° bias package of the instant invention. The insert may be fabricated from a large number of different materials and the design can vary appreciably so long as the bottom edge, which may be in contact with the solid material, is an essentially flat surface having the appropriate bias angle. For economy, a folded false top cardboard used of the type illustrated in FIG. 6 is particularly advantageous. This particular insert has an additional feature, i.e. slotted end, which allows for expansion of the solid contents under extreme conditions of temperature and/or pressure which could be occasionally encountered in storage and shipment. Other conventional materials may be used including plastic and other molded objects. Since the bottom portion of the insert will usually be in direct contact with the dimensionally stable solid, it is important that the surface must be non-adhering to the solid or treated by conventional means to allow removal of the false top without substantial distortion of the solid contents. A preferred material is 20 pt., cylinder board with a bonded layer of 0.0008 inch aluminum foil.

Figure 7:
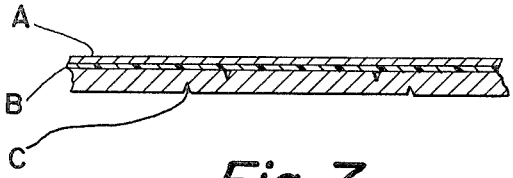
FIG. 7 is a cross-sectional view of the external cylinder board with aluminum foil lining bonded thereto.

FIG. 7 shows an advantageous inner lining consisting of about 0.0008 inch aluminum foil barrier (A). Particularly note the off-set positions of the external and internal die-cuts in the cylinder board and the interposition of a poly interface (B) between the outer cylinder board (C) and the internal foil lining (barrier). Although the inner lining may be completely separate from the external container, it is preferably bonded to the outer package. In a preferred system, the die-cuts are made on the inner surface of the paperboard or cylinder board, the aluminum foil is then bonded to the inner surface and die-cuts are then made on the external surface of the paperboard. Suitable liners which make effective barriers include: cellulosics, polycarbonates, polypropylene, polyester or metallized plastic sheet material. Aluminum foils of about 0.0003 to 0.001 inch thickness are especially preferred. The liner must have the ability to propagate a tear after nipping.

Referring further to the false bottom, it is noted that this insert may be fabricated from various materials including cardboard, wood, coated paper, and plastic materials provided these structures are capable of performing the functions required by said insert. The false bottom anchors the dimensionally stable solid material to the package and prevents dislocation of the gel material "heel". Such insert also contributes stability to the overall package and lends support to prevent deformation on storage and shipment. A particular advantageous function of the insert is that it allows the applicator to be firmly gripped and held in the hand of the person using said applicator in dispensing the contents to a substrate surface. An additional function of the insert is to hold the paint block firmly in place as the solid material is consumed by application to a substrate and the various tear strips are consecutively removed.

Figure 8:
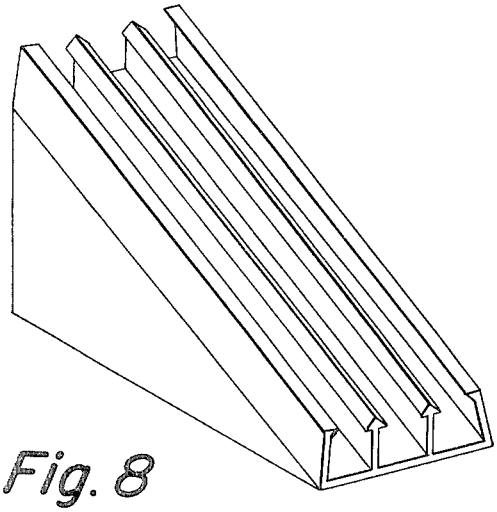
FIG. 8 is a drawing of a suitable bias angled false bottom.
Figure 9:
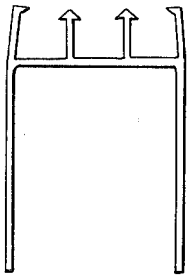
FIG. 9 is an end view of a rectangular shaped false bottom.

The specific design of the false bottom inserts shown in FIGS. 8 and 9 accomplishes all of the above functions. Although other types of structural ribs can be employed including individual spikes, spurs, or holding components of various design, the rib section structure illustrated is particularly advantageous in holding the heel of the solid material essentially in place. This structural feature thus allows maximum paint utility and conservation and prevents the premature dislodging of the paint heel as the material is depleted. The false bottom insert may be of the bias angle type shown in FIG. 8 or may be a rectangular horizontal type as depicted in FIG. 9, the latter being preferred for most purposes. As shown in FIG. 9, the rectangular insert comprises a base structural section containing two or more legs and a top section having a multiplicity of spur-type panels positioned lengthwise parallel to two side panels.

The outer spurs, adjacent to the package sides, are preferably angled about 4 degrees from the vertical position toward the center and this allows the liquid paint to flow between the package wall and the spur at the time of filling. This acts to bond and anchor the false bottom to the package wall when the paint solidifies. These outer spurs advantageously may contain a cavity portion which enhances the bond. The side panels can be an extension of the leg portion of the base. It is appreciated that for small to medium size applicator packages the top spur portion can retain essentially the same dimensions while the leg portion and width can be modified to accomodate the various package sizes. As the package size becomes larger, more structural ribs may be added. For large packages exceeding one quart capacity, additional leg positions may be necessary to provide adequate support.

What is claimed is:

1. A container/applicator bias trim package for storing and applying a dimensionally stable gel deformable on contact with a surface on which said material may be deposited as a coating or treatment which comprises:

(a) an assembled outer shell having one or more individually removable tear strips whereby the dimensionally stable and deformable gel may be exposed for application to a substrate; wherein the tear strips are formed by die-cutting the external and internal surfaces of the outer shell at a bias angle from the horizontal, said resulting die-cuts being substantially parallel to, but slightly displaced from, one another;

(b) an inner lining which functions as a barrier to contain the deformable gel;

(c) a false bottom which functions to anchor the dimensionally stable gel within said container, to support the entire package on shipment and storage, and to allow said package to be conveniently grasped in the hand for manual application of said gel to a substrate, (d) a removable false top insert positioned at the top of the package, the bottom surface of which is formed at a bias angle of about 20° to 45° and serves to mold the gel at a bias angle when the inverted package is filled while the gel is still in a fluid state, said insert being removable on opening of the container, the bottom surface of said top insert lying in a plane substantially parallel to the bias angle formed by the tear strips.

2. An applicator of claim 1 filled with a dimensionally stable and deformable gel wherein the gel is molded at a bias angle of 30°.

3. An applicator of claim 2 wherein the deformable gel is a solid paint.

4. An applicator of claim 2 wherein the deformable gel is a solid adhesive.

5. An applicator of claim 1 wherein the outer shell is cardboard, the false top insert is cardboard, and the inner lining is aluminum foil laminate.

6. An applicator of claim 1 wherein the false bottom comprises a hollow leg portion and upper portion having multiple spurs.

7. An applicator of claim 3 wherein the false bottom is a rectangular plastic insert comprising a bottom leg section and a top spur section capable of anchoring the gel material.

8. An applicator of claim 7 wherein the side spurs are tilted about 4–8 degrees toward the center and have a curved cavity portion useful in bonding the outer shell, the solid paint and the bottom insert.

9. A solid paint applicator comprising a rectangular box-like container having therein a solid, dimensionally stable block of gel paint that can be applied to a surface by wiping an exposed edge of the paint block over the surface while pressing it against the surface, said package having an application end and width, depth and height dimensions and a grasping end, said block being truncated at the application end of the package to provide a planar bevel face that permits application of the paint over a wider swath than the width dimension of the package as measured at the application end of the package nearest the wiping edge of the paint block, a false top disposed in the package and filling the space between the bevel face of the paint block and the end of the container at the application end of said package, said container package comprising sheet material and having a series of lines of weakness circumscribing the side walls of the container and spaced from each other, said lines of weakness defining a series of c ntiguous individual strips therebetween, said strips being angularly disposed relative to a central axis passing through opposite ends of said container and each strip being individually removable from the container, the lines of weakness being disposed so that the edges of each strip respectively lie in a plane that is generally parallel to the plane of the bevel face of the paint block, a false bottom structure disposed in the container at the grasping end thereof, said false bottom structure including a base portion that conforms to the shape of the container and that reinforces it against pressure that may be exerted while grasping the container to apply the paint, said structure being provided with anchoring means that project from said base portion into embedded relation in the block of paint in the grasping end of the container to secure the paint block against movement relative to said false bottom structure, whereby said individual strips at the application end of the box-like container may be removed sequentially to open said package and to expose the bevel face of the block of paint for use, while the grasping end may be held to permit use of that end of the container as an applicator for the block of paint.

10. The applicator package of claim 9 wherein said false bottom structure is formed with a plurality of upstanding ribs that project into said paint block to provide said anchor means, said ribs being disposed generally in parallelism with each other, and each being enlarged at its free end within the paint block, the paint block enveloping each said enlarged end, thereby providing a mechanical interlock, there being at least one of said ribs disposed in close proximity to but spaced from one inner surface of the container wall, the paint extending between said rib and said wall surface and bonding the rib to the wall surface.

11. The applicator package of claim 10 wherein said false bottom structure is shaped to have generally the same shape as the space between the bevel face of the paint block and the container at its application end, and the paint block is shaped at its end engaging said false bottom structure to conform to the shape of said false bottom structure, and wherein the bevel face of the paint block has a greater length than width, and wherein the angle between the end face of the container and the bevel face of the paint block is about 30°.

* * * * *